US007434370B1

(12) United States Patent
Scott et al.

(10) Patent No.: US 7,434,370 B1
(45) Date of Patent: Oct. 14, 2008

(54) CAPPING HEADS WITH A MAGNETIC CLUTCH

(75) Inventors: Michael P. Scott, Midland, MI (US); Larry D. Dotson, Midland, MI (US)

(73) Assignee: Precision:Torque Control, Inc., Midland, MI (US)

( * ) Notice: Subject to any disclaimer, the term of this patent is extended or adjusted under 35 U.S.C. 154(b) by 0 days.

(21) Appl. No.: 11/823,645

(22) Filed: Jun. 28, 2007

(51) Int. Cl.
*B65B 3/02* (2006.01)

(52) U.S. Cl. ..... 53/331.5; 53/317; 53/343; 53/490; 192/56.4; 192/56.41

(58) Field of Classification Search ..... 53/331.5, 53/317, 343, 490; 192/56.4, 56.41
See application file for complete search history.

(56) References Cited

U.S. PATENT DOCUMENTS 4,222,215 A * 9/1980 Takano ..... 53/331.5
4,246,738 A * 1/1981 Ono ..... 53/331.5
4,364,218 A * 12/1982 Obrist ..... 53/331.5
4,674,264 A * 6/1987 Ellis et al. ..... 53/331.5
5,197,258 A 3/1993 Johanek
5,437,139 A 8/1995 Martin
5,490,369 A * 2/1996 Ellis et al. ..... 53/317
5,714,820 A 2/1998 Mitsuhashi et al.
5,809,742 A 9/1998 Takakusaki et al.
6,240,678 B1 6/2001 Spether
7,181,892 B1 2/2007 Scott et al.

* cited by examiner

*Primary Examiner*—Thanh K Truong
(74) *Attorney, Agent, or Firm*—Robert L. McKellar; McKellar IP Law, PLLC

(57) ABSTRACT

Capping head assemblies that are useful for applying pre-threaded closures onto containers with improved sensitivity.

The novel features of the devices are a simple and novel means of adjusting the torque in a magnetic clutch assembly. In addition, the advantage of preventing contamination by water and other liquids during the filling and capping of liquid containers, and further, have the capability of being greased without having to disassemble the device. In addition, these can be accomplished without changing the capability of being able to read the adjustment scales on the outside surface of the magnetic clutch assembly and the adjustment scales on the outside surface of the upper spring assembly for adjusting the tension in the spring.

9 Claims, 9 Drawing Sheets

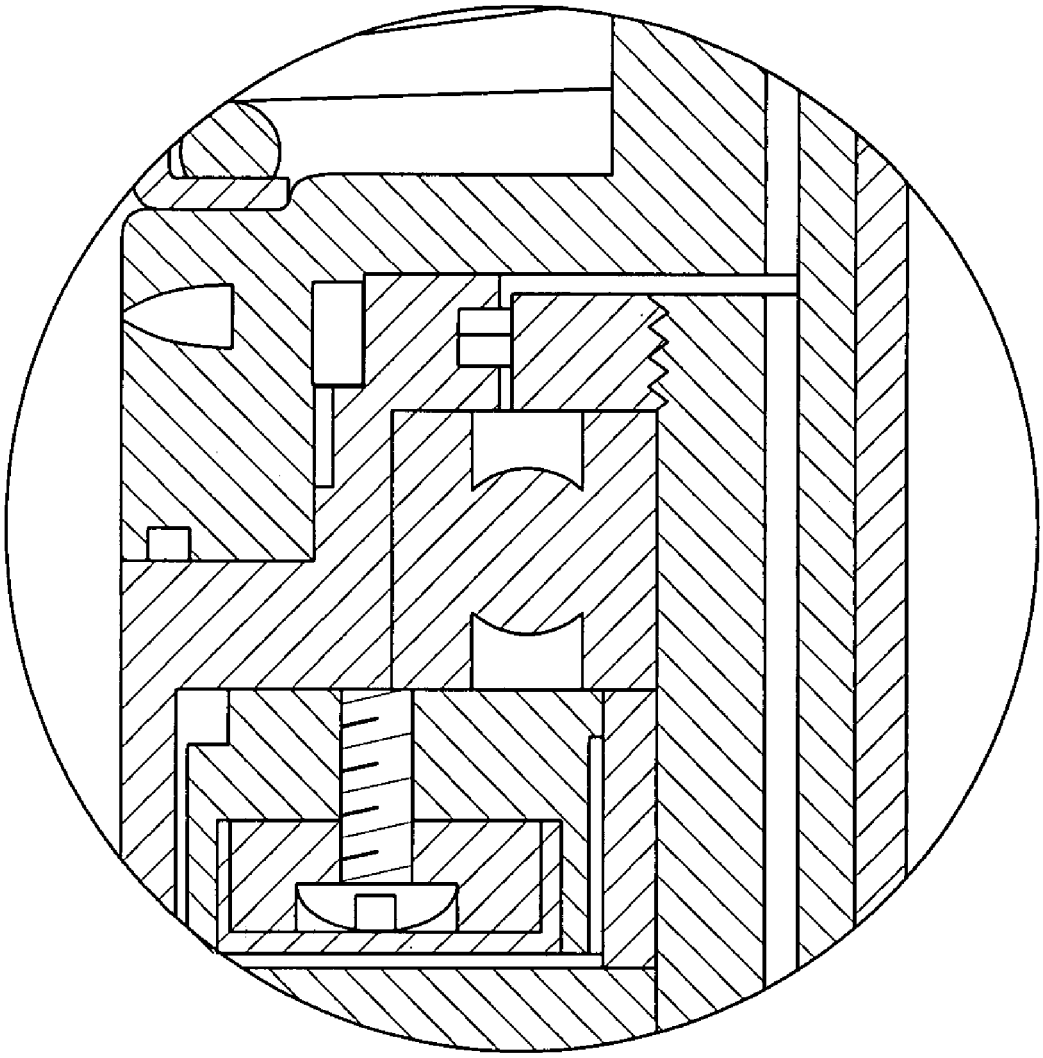
FIG.8 SECTIONAL ENLARGEMENT

CAPPING HEADS WITH A MAGNETIC CLUTCH

The invention claimed and disclosed herein deals with devices that are useful for applying pre-threaded closures onto threaded containers with improved sensitivity.

BACKGROUND OF THE INVENTION

It is known in the art to use capping devices for applying threaded caps to pre-threaded containers. Such devices utilize a clutch to control the amount of torque applied to the cap so that the container is properly closed but prevents too much torque from being applied that could strip the threads of the container and the cap. Also, it is desired to prevent the over tightening of the cap.

This has been accomplished by using rings of concentric magnets with some form of control to control the axial position of the magnets. Various devices have also incorporated rings of magnets of alternating polarity. Even though such devices have been available, they have tended to be complex and costly, and not very reliable with regard to retaining a pre-set torque, and thus many capping devices utilizing spring loaded mechanical and friction clutches are still in use but a need still exists for a device incorporating a reliable and simplified but effective clutch mechanism.

One prior art device can be found in U.S. Pat. No. 5,197,258, issued Mar. 30, 1993 to Johanek in which a clutch is adapted for use in a capping device to apply a pre-selected amount of torque to the driven component having a pair of axially aligned circular cylinders of equal diameter each having a generally smooth engaging surface facing the other clutch cylinder. Each of the cylinders has cavities in the rear side for containing magnets. The magnets are secured in the cavities by means of a cured polymeric resin. The maximum torque provided by the clutch is controlled by using removable spacer disks of varying thicknesses and having a diameter equal to that of the cylinder positioned between the engaging surfaces.

The device disclosed in U.S. Pat. No. 5,437,139, issued on Aug. 1, 1995 to Martin deals with a cylindrical magnet ring in the body of the head surrounding a cap chuck driving element in a low friction bearing in the head, each having an array of permanent magnets, distributed around the periphery. The chuck-driving element rotates with the magnet ring until the resistance of a cap being threaded on the container exceeds a predetermined torque limit, after which the magnet ring rotates relative to the stationary chuck-driving element. The spring for urging the chuck downward is fully contained within the head.

Yet another device is that found in U.S. Pat. No. 5,809,742, that issued on Sep. 22, 1998 to Takakusaki, et al in which a plurality of permanent magnets are embedded around the entire outer periphery at the upper end of a spindle with adjacent permanent magnets presenting magnetic poles of different polarities. As the capping head moves through a threadable engaging zone, co action between the permanent magnets causes the capping head to rotate clockwise causing a cap to be threadably engaged with a container.

U.S. Pat. No. 5,714,820, that issued on Feb. 3, 1998 to Mitsuhashi, et al deals with magnetic coupling that includes a cylindrical housing, a spindle, an adjusting plate, two pairs of permanent magnet discs, two hysteresis material discs, and a screw member.

The spindle is rotatably supported at its axial position by the housing. The adjusting plate is rotatably supported by the spindle to partition as interior of the housing into two sections in a direction of the spindle. The two pairs of permanent magnets are provided in the two corresponding section to respectively oppose each other. One of each pair of permanent magnet discs is fixed in the housing and the other thereof is fixed to the adjusting plate. Each permanent magnet disc has magnetic poles with polarities that alternate in a circumferential direction. The hysteresis material discs are fixed to the spindle and arranged between the corresponding pairs of permanent magnet discs at a predetermined gap. The screw member fixes the adjusting plate to the housing. When the adjusting plate is released and pivoted, the mutual positional relationships between the respective opposing magnetic poles of the two pairs of permanent magnet discs are adjusted simultaneously.

U.S. Pat. No. 6,240,678 that issued Jun. 5, 2001 to Spether deals with a capping head assembly that has a first housing with a spindle-mounting collar and supports a clutch housing. The clutch housing has an upper portion with a first magnetic ring and a lower portion with a second magnetic ring. The lower portion is freely rotatable relative to the upper portion and permits the adjustment of the air gap between the first and second magnetic rings. A locking mechanism maintains the adjusted air gap at a selected value that represents a definable torque level in the magnetic clutch. The capping head also includes a post assembly calibration system that establishes a known reference point that compensates for manufacturing tolerances between individual capping heads.

There is disclosed in U.S. Pat. No. 5,490,369 that issued Feb. 13, 1996, to Ellis, a capping head with magnetic clutch that includes a housing assembly including a magnetic clutch interconnecting a drive spindle and a quill for applying a closure to a container. The magnetic clutch consists of opposed rings of magnets and one of the rings is disposed in a piston ring assembly that is quick and easily adjustable relative to the other to vary the torque limit of the clutch. A simple yet efficient clamping assembly is employed to facilitate ready adjustment and retention of the movable piston ring.

There is shown in an Arol Company brochure, not dated, a synchronous magnetic type of head. This device differs from the device herein by the use of straight sided ball bearings as the contact thrust bearing, but more importantly, it uses a synchronous magnetic type of head as opposed to the hysteresis type of head as used in the inventive device herein.

Basically, the synchronous clutch utilizes two discs with multiple magnets that are set up to oppose each other. To rotate one of the discs relative to the other disc you must overcome the magnetic attraction from the north pole to the south pole. The torque is a pulsating torque from zero to maximum. The number of magnets located around the disc will determine how many pulsations there will be in one revolution. To change peak torque levels in this type of design you need to adjust the air gap between the magnets. Larger air gaps provide for smaller peak torques.

U.S. Pat. No. 7,181,892, that issued on Feb. 27, 2007 to the inventors herein deals with a capping head with a magnetic clutch that is useful for applying pre-threaded closures onto threaded containers with improved sensitivity. The device allows for the adjustment of the torque that is required for capping containers such that variable sized and variable types of containers can be capped.

In the instant invention, essential construction and attributes of the devices that are disclosed in the aforementioned '892 patent are also a part of this devices herein, and in addition, the devices of the instant invention are constructed such that they can be cleaned using spray washing without the water affecting any part of the device.

In addition, the construction of the instant devices is such that the liquids that are contained in the containers to be capped do not affect the devices of this invention when they splash and wash over the equipment that is used to cap the containers.

In addition to the novel cup assemblies that cover the devices, this invention teaches the correct sealing that is needed to provide unaffected devices and further, discloses an inventive method of greasing the components without having to disassemble the devices.

None of the devices disclosed in the prior art have the advantages of the devices of the instant invention. None of the devices disclosed in the prior art have the simplicity and novel means of adjusting the torque in the magnetic clutch assembly as does the device of the instant invention. In addition, the devices of this invention have the advantages of preventing contamination by water and other liquids during the filling and capping of liquid containers, and further, have the capability of being greased without having to disassemble the device. In addition, the improvements on the inventive devices can be accomplished without changing the capability of being able to read the adjustment scales on the outside surface of the magnetic clutch assembly, nor the adjustment scales on the outside surface of the upper spring assembly for adjusting the tension in the spring, that are novel features of these devices.

THE INVENTION

In a first embodiment, the invention disclosed and claimed herein deals with capping head assemblies comprising a combination of a magnetic clutch assembly having an upper portion and a bottom edge and which comprises a first annular drive magnet in a torque ring that is not movable relative to the magnetic clutch assembly. The drive magnet has a multiple pole configuration and there is a second annular drive magnet in the magnetic clutch assembly and it has a multiple pole configuration. There is a moveable hysteresis annular magnet interposed between the drive magnets, said magnets being axially spaced from each other.

There is a means for adjusting the position of the torque ring relative to the magnetic clutch assembly, the means comprising a torque adjustment rotating end cap that changes the polarity of the second annular magnet in the magnetic clutch assembly relative to the first annular drive magnet in a predetermined position whereby the flux of the magnets can be changed to vary the torque limit of the magnetic clutch assembly. The torque adjustment rotating end cap is rotatably mounted in the bottom end of the magnetic clutch assembly.

There is a means for securing the torque ring relative to the magnetic clutch assembly to retain the torque ring in a fixed position.

There is a double row angular contact thrust bearing located in the upper portion of the magnetic clutch assembly and encircling the rotatable drive member, the double row angular contact thrust bearing surmounting the first annular series of magnets.

Optionally, there is a top load spring setting scale tooled into the outside surface of the first housing assembly and optionally, an application torque setting scale tooled into the outside surface of the magnetic clutch assembly, near the bottom edge thereof. It is contemplated within the scope of this invention to have a device that contains both a top load spring setting scale tooled into the outside surface of the first housing assembly and an application torque setting scale tooled into the outside surface of the magnetic clutch assembly.

There is a first housing assembly having an upper portion and a lower portion, wherein the lower portion has an outside wall and the first housing assembly is shielded by a two-piece cup assembly.

The two-piece cup assembly comprises an independent upper cup having an open bottom, a top and a bottom edge. The top has a large central opening through it. The upper cup is mounted over the compression spring and the upper cup is retained in place by the spring retention plate.

There is an independent lower cup. The lower cup has a bottom, an open top, and an outside surface and the bottom has a large central opening through it. The lower cup is mounted under the compression spring and the lower cup is retained in place by the adjustment ring while the bottom edge of the upper cup slidably overlaps the outside surface of the lower cup.

The upper double row angular contact thrust bearing magnetic clutch housing and the upper end of the lower shaft contains a seal between them to seal the bearings. The first housing assembly housing and the outside edge of the upper double row angular contact thrust bearing magnetic clutch housing also have a seal between them.

There is a multiple component grease port assembly contained in the interior of the wall of the lower portion of the first housing assembly housing. The multiple component grease port assembly comprises a first vertical shaft having a predetermined diameter less than the thickness of the wall of the lower portion of the first housing assembly, a top end, a bottom end, an upper segment, and a lower segment.

The first vertical shaft has a first opening in the top that is sealed with a removable plug. The lower segment has a diameter less than the diameter of the upper segment and the first vertical shaft has a second opening through the side wall of the first vertical shaft upper segment leading to the upper portion of the first housing assembly.

The first vertical shaft has contained in it a resilient spring surmounting a metal ball bearing. The spring and the metal ball bearing are in contact with each other. The metal ball bearing located at and rests at the juncture of the upper segment and the lower segment of the first vertical shaft.

The second vertical shaft openly connects to the first vertical shaft. The second vertical shaft has a bottom end, and the bottom end is sealed with a removable plug. There is an angled shaft openly connected to the second vertical shaft and it opens through the outside wall of the lower portion of the first housing assembly housing.

In a second embodiment, this invention comprises a capping head assembly comprising a first housing assembly securable to a drive spindle, through a spindle adapter. The first housing assembly has an outside surface and a top portion, a middle portion, and a lower portion.

There is a spring retention plate surrounding the first housing assembly, the spring retention plate comprising a combination of a lower jam nut and an upper adjustment ring.

There is a compression spring mounted beneath the lower jam nut and it surrounds the first housing assembly. The spring slidably rests on a portion of a magnetic clutch housing. The first housing assembly is shielded by a two-piece cup assembly, the first housing assembly having an upper portion and a lower portion. The lower portion has an outside wall and is shielded by a two-piece cup assembly, the two-piece cup assembly comprising an independent upper cup having an open bottom, a top and a bottom edge. The top has a large central opening through it and the upper cup is mounted over the compression spring, and under the adjustment nut. The upper cup is retained in place by the adjustment nut.

There is an independent lower cup. The lower cup has a bottom, an open top, and an outside surface. The bottom has a large central opening through it. The lower cup is mounted under the compression spring and is retained in place by a first upper housing of a magnetic clutch assembly. The bottom edge of the upper cup slidably overlaps the outside surface of the lower cup. The outside surface of the lower cup has multiple circumferential lines having a predetermined spacing between them, tooled into the outside surface.

There is a magnetic clutch assembly housing comprising an upper housing containing a metal tube comprised of a lower portion having a top edge, and an upper nut portion having a lower edge and a top, the top edge of the lower portion and the lower edge of the upper nut portion being threaded such that they mate and thread together. The nut has a flange at the top. The flange has a diameter larger than the diameter of the upper housing, the difference in diameter of the upper housing and the flange, provides a stop for any upward movement of the first housing assembly. There is a plastic tube insert fitted on the inside of the metal tube. The upper housing has a bottom end outside edge.

The lower housing comprises a container for magnetic components for the capping head assembly. The lower housing has a top, a shouldered portion near the top, an outside wall, and an interior hollow shaft with a bottom portion, and a bottom edge.

The shaft has a threaded upper end, and is held in place by a threaded ring nut wherein the threads of the threaded wing nut mate with the threaded upper end of the hollow shaft.

The lower housing houses a first annular drive magnet in a torque ring that is not movable relative to the magnetic clutch assembly. It has a multiple pole configuration. The first annular drive magnet is held in place by a first magnet plate.

There is a second annular drive magnet in the magnetic clutch assembly that has a multiple pole configuration, the second annular drive magnet is also held in place by a second magnet plate.

There is a moveable hysteresis annular magnet interposed between the first and second annular drive magnets, the magnets being axially spaced from each other, and each drive magnet being potted in a potting compound.

There is means for adjusting the position of the torque ring relative to the magnetic clutch assembly, the means comprising a torque adjustment rotating end cap that changes the polarity of the second annular magnet in the magnetic clutch assembly relative to the first annular drive magnet in a predetermined position whereby the flux of the magnets can be changed to vary the torque limit of said magnetic clutch assembly. The torque adjustment rotating end cap is rotatably mounted in the bottom end of the magnetic clutch assembly.

Further, there is a means for securing the torque ring relative to the magnetic clutch assembly to retain the torque ring in a fixed position and there is a first radial ball bearing located supra to the first annular drive magnet and it encircles the rotatable drive member.

There is a second radial ball bearing located infra to the second annular drive magnet and it encircles the rotatable drive member as well.

The threaded ring nut and the upper portion of the shouldered second lower housing contain a seal between them to seal the bearings and the upper housing bottom end outside edge and the lower housing shouldered portion near the top having a seal between them as well.

There is a seal between the torque adjustment rotating end cap and the bottom portion of the interior hollow shaft and a seal between the second magnet plate and the lower edge of the lower housing of the magnetic clutch assembly.

A further embodiment of this invention is a capping head assembly as set forth Supra wherein the first housing assembly has a multiple component grease port assembly contained in the interior of the wall of the first housing. The multiple component grease port assembly comprises a first opening in the first housing assembly wall that contains a grease zerk in it.

It also contains a first vertical shaft. The first vertical shaft has a predetermined diameter less than the thickness of the wall, a top end, a bottom end and a first opening in the top end that opens to the grease zerk.

The second vertical shaft has a diameter greater than the first vertical shaft, but less than the thickness of the wall, the second vertical shaft having an upper opening and a lower opening, the upper opening aligning with the bottom end of the first vertical shaft and the bottom end having an opening passing through the wall and into the lower housing.

The capping head assemblies of this invention have several other improvements over prior art devices that provide additional advantages, namely, there are more radial holes in the clutch body for machines having little space. This makes it easier to install and remove headsets.

In addition, there are more radial holes in the top load spring adjustment rings. This makes it easier to adjust the top load on the machine. Further, the devices of this invention have reduced inertia output nuts that reduce the torque variation with changes in bottling speed.

The devices of this invention also have reduced inertia internal magnets that reduce the torque variation with changes in bottling speed and as will be note infra, there are spring covers with adjustment height guides tooled into them to provide instant visual settings to adjust the turret height of the capping machine.

Still other improvements are color coded high and low force springs that provide quick visual reference for which spring is in the headset and there are new seals in conjunction with the use of the spring covers that provide protection in steam, water, and hot fill applications. This combination provides longer life in these kind of applications.

Finally, the devices of this invention have a changed greasing situation in that improved grease distribution assemblies and improved grease retention are provided in the top load assembly.

DETAILED DESCRIPTION OF THE INVENTION

Figure 1:
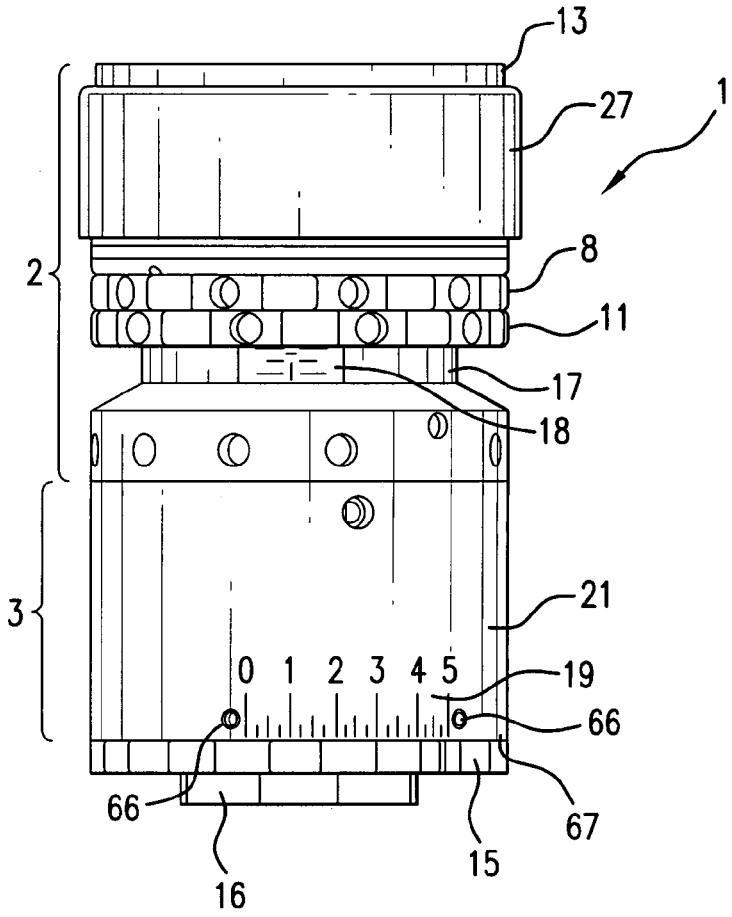
FIG. 1 is a full front view of one device of this invention.

Thus, the invention disclosed and claimed herein deals with a capping head assembly 1 for capping containers. Turning now to FIG. 1, there is shown a full front view of the device 1 of this invention. There is shown a first housing assembly 2 that is securable to a drive spindle, not shown, and a magnetic clutch assembly 3.

Figure 4:
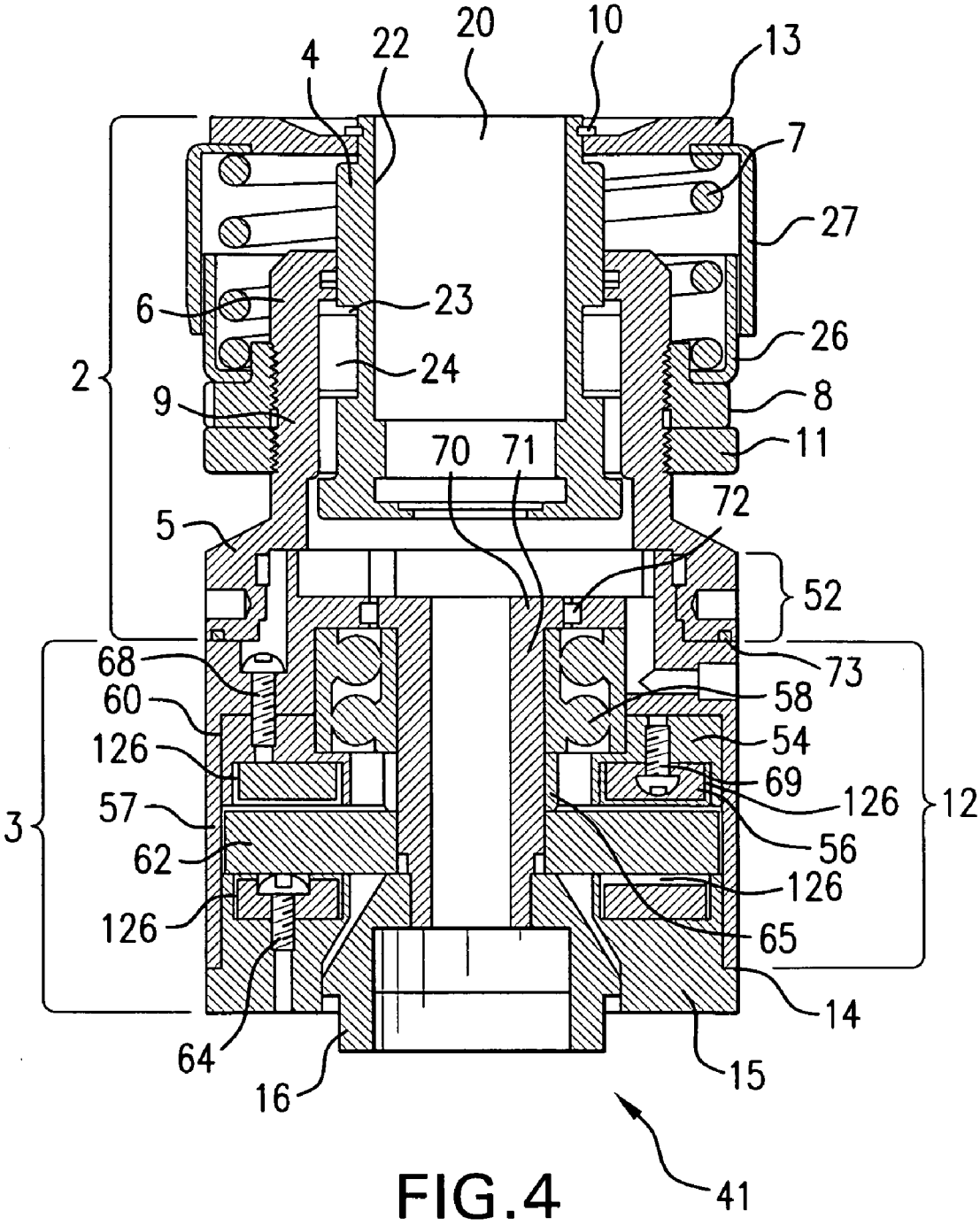
FIG. 4 is a full cross sectional side view of a device of this invention through the line B-B of FIG. 2 wherein the device has been revolved about 90°.

With reference to FIG. 4, there is shown the first housing assembly 2 that has a top portion 4 and a lower portion 5, wherein the lower portion 5 has an upper segment 6. The first housing assembly 2 has a compression spring 7 surrounding it.

The compression spring 7 is mounted beneath a spring retention plate 13 and held in place around the first housing assembly 2 by the spring retention plate 13 and the spring retention plate 13 is held in place by a retainer ring 10. The compression spring 7 slidably rests on a moveable spring pre-load adjustment ring 8 that is threadedly mounted around the middle portion 9 of the first housing assembly 2 and said moveable spring pre-load adjustment ring 8 works in conjunction with a jam nut 11 to provide an adjustment for the compression spring 7 in a vertical movement, and the jam nut 11 prevents the adjustment ring 8 from moving in either direction. This assembly allows one to control the amount of compression that is used in the assembly.

Threaded onto the bottom of the first housing assembly 2 is a magnetic clutch assembly 3, said magnetic clutch assembly 3 has an upper portion 12 and a bottom edge 14. Shown at the bottom edge 14 is a torque adjustment rotating end cap 15 which is used to adjust the internal magnets, discussed infra, and, a magnetic assembly clamping nut 16.

Shown on the outside surface 17 of the first housing assembly 2 is a spring pre-load setting index 18 that is tooled into the outside surface 17. Also shown is a torque setting index 19, that is located near the bottom edge 14 of the magnetic clutch assembly 3 and this index 19 is also tooled into the outside surface 21 of the magnetic clutch assembly 3, just above the torque adjustment rotating end cap 15.

Figure 2:
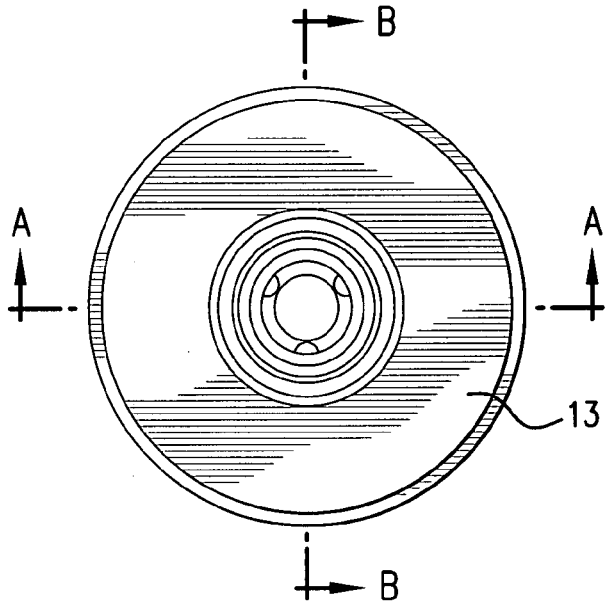
FIG. 2 is a full top of the device of FIG. 1.

With regard to FIG. 4, there is shown a full cross sectional side view of the device 1 of this invention, taken through line B-B of FIG. 2.

There is shown a mounting shaft opening 20. Also shown is the spring retention plate 13, the retainer ring 10, compression spring 7, moveable spring pre-load adjustment ring 8 and jam nut 11. In addition, there is shown the magnetic assembly clamping nut 16 and the torque adjustment rotating end cap 15.

The wall 22 of the top portion 4 of the first housing assembly 2 has semi-cylindrical indentions 23 located therein, typically about four such indentions. The indentions 23 are circumferentially located about the first housing assembly 2 and each holds a metal pin 24, which acts as a device to transmit torque from the drive spindle, thru wall 22 to the bottom portion 5 of the first housing assembly 2. Typically there are four such metal pins 24 in each first housing assembly 2 and it is preferred that these pins are manufactured out of stainless steel to prolong the life of such pins. The torque from the drive shaft is transmitted to the first housing assembly 2 through the metal pins 24. This permits the upper portion 4 of the first housing assembly to move relative to the entire first housing assembly 2 against the action of the compression spring 7 during which action the metal pins 24 will move in the semi-cylindrical indentions 23. The metal pins 24 provide a positive connection between the first housing assembly 2 and the lower portion 5 of the first housing assembly 2.

The lower portion 5 of the first housing assembly 2 has a threaded connection between the first housing assembly 2 and the upper portion of 12 of lower assembly 3.

A novel feature of these inventive devices is that the first housing assembly 2 is shielded by a cup assembly 25, that is comprised of two cups, a lower cup 26 and an upper cup 27, both of which are independently mounted on and around the first housing assembly 2. The upper cup 27 has an open bottom 28, a top 29, and a bottom edge 30. The top 29 has a large center opening 31. The large center opening 31 is needed to accommodate the mounting of the upper cup 27 over the first housing assembly 2, in that the upper cup 27 is mounted over the compression spring 7 and is retained in place by the spring retention plate 13.

The lower cup 26 has a bottom 32, an open top 33, and an outside surface 34. The bottom 32 has a large central opening 35 through it to accommodate the first housing assembly 2. The lower cup 26 is mounted under the compression spring 7 and is retained in place by the adjustment ring 8. The bottom edge 30 of the upper cup 27 slidably overlaps the outside surface 34 of the lower cup 26.

The combination of the lower cup 26 and the upper cup 27 prevents liquids from entering the first housing assembly 2, and this is in combination with certain seals that will be discussed infra.

Because of the this cup arrangement, there is no ready access to the interior of the first housing assembly 2 to enable one to grease the interior, especially the pins 24 and the sliding surfaces adjacent thereto. For this reason, the first housing assembly 2 has a novel assembly to enable one to grease the interior of the first housing assembly 2.

Figure 3:
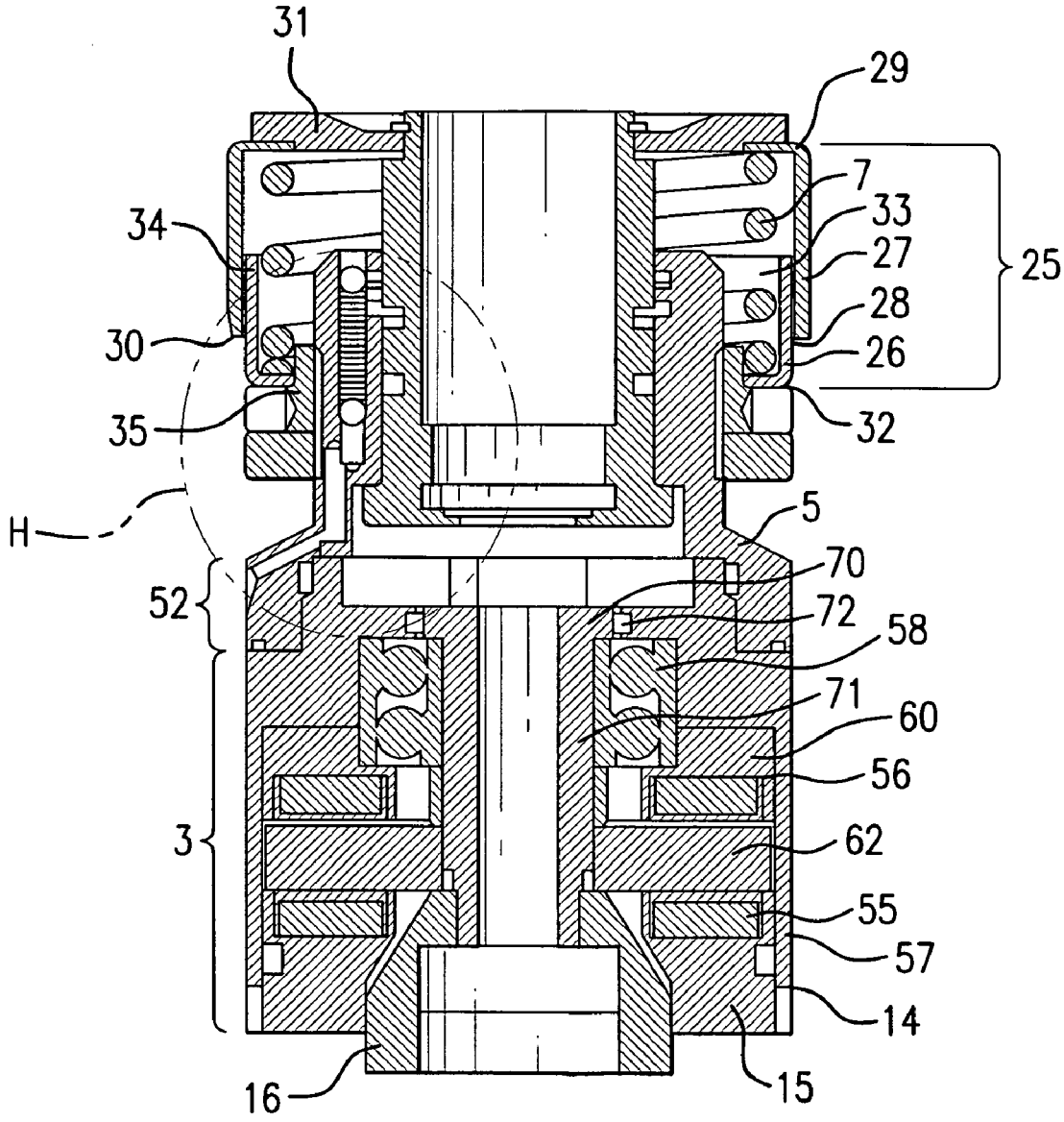
FIG. 3 is a full cross sectional front view of a device of this invention through the line A-A of FIG. 2.
Figure 5:
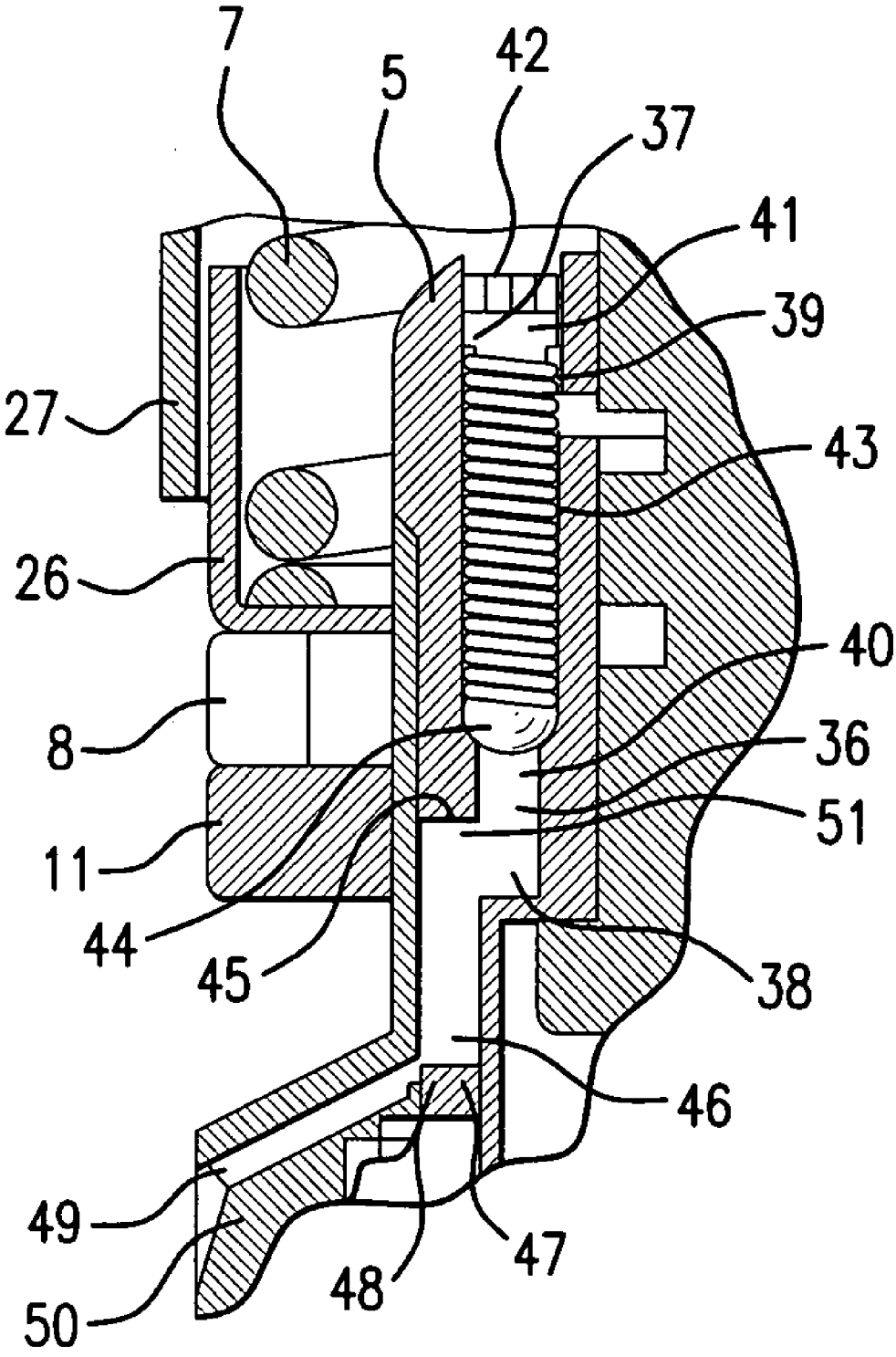
FIG. 5 is an enlarged view of the area H of FIG. 3 showing the details of the grease assembly.

Turning now to FIG. 3, which is a cross sectional full side view of the device of FIG. 1, taken through line B-B of FIG. 2 and FIG. 5, which is an enlarged grease assembly taken from area H of FIG. 3, this novel grease assembly is contained in the wall of the lower portion 5 of the first housing assembly 2 and is comprised of a first vertical shaft 36 within the upper segment 6 of the wall 22. This first vertical shaft 36 has a predetermined diameter of less than the thickness of the wall 22. The first vertical shaft 36 has a top end 37, a bottom end 38, an upper segment 39, and a lower segment 40. The first vertical shaft 36 has a first opening 41 in the top end 37 that is sealed with a removable plug 42. The lower segment 40 has a diameter less than the diameter of the upper segment 39. The first vertical shaft 36 has a second opening 51 through the sidewall of the first vertical shaft upper segment 39 that leads to the upper portion 5 of the first housing assembly 2.

The first vertical shaft 36 has contained in it, a resilient spring 43 surmounting a metal ball bearing 44 and the metal ball bearing 44 and the resilient spring 43 contact each other. The metal ball bearing 44 is located at the juncture 45 of the upper segment 39 and the lower segment 40 in the first vertical shaft 36.

There is a second vertical shaft 46 openly connected to the first vertical shaft 36 and the second vertical shaft 46 has a bottom end 47 that is sealed with a removable plug 48.

Finally, the novel grease assembly has an angled shaft 49 that is openly connected to the second vertical shaft 46 and this angled shaft 49 opens through the outside wall 50 of the lower portion 5 of the first housing assembly housing 2.

When grease is applied to the angled shaft 49 at the opening in the outside wall 50, the grease advances through the second vertical shaft 46 to the first vertical shaft 36 and then through the second opening 51 and into the interior of the first housing assembly 2 thereby allowing for the capability of greasing the interior of the first housing assembly 2 without having to disassemble the first housing assembly 2.

Further with regard to FIG. 3, there is shown the magnetic clutch assembly 3. There is an upper portion 52 and a bottom edge 14. The magnetic clutch assembly 3 comprises a first annular drive magnet 56 in a torque ring 54 that is not movable relative to the magnetic clutch assembly 3. The first annular drive magnet 56 has a multiple configuration. There is a second annular drive magnet 55 in the magnetic clutch assembly 3 and this magnet has a multiple pole configuration. There is a means for adjusting the position of the torque ring 54 relative to said magnetic clutch assembly 3 and this means comprises a torque adjustment rotating end cap 15 that changes the polarity of the second annular magnet 55 in the magnetic clutch assembly 3 relative to the first annular drive magnet 56 in a predetermined position whereby the flux of the magnets through the hysteresis magnet 62 can be changed to vary the torque limit of the magnetic clutch assembly 3. The torque adjustment rotating end cap 15 is rotatably mounted in the bottom end 14 of the magnetic clutch assembly 3.

Located within an upper double row angular contact thrust bearing magnetic clutch housing 57 is a annular double row angular contact bearing 58, which bearing has not been used in this type of assembly to the patentee's knowledge. The contact bearing 58 surrounds the lower shaft 71 and rests on a magnet mounting plate 54, and just beneath the magnet mounting plate 54 is a non-moveable annular first drive magnet 56. Directly seated beneath the non-moveable annular first drive magnet 56 is an annular hysteresis magnet 62, and just directly beneath the hysteresis magnet 62 is a moveable annular second drive magnet 55. The moveable annular second drive magnet 55 is held in place and attached to the torque adjustment rotating end cap 15 by screw or bolt 64.

It should be noted that the combination of the lower shaft 71, a spacer 65, the contact bearing 58 and the hysteresis magnet 62 are all held in place by the shaft nut 16. The moveable annular second drive magnet 55 is attached to the torque adjustment rotating end cap 15. By turning the torque adjustment rotating end cap 15, the moveable annular second drive magnet 55 can be moved in a circular motion.

Both of the annular drive magnets 56 and 55, are magnetized in a multiple pole configuration. If one envisions a pie that has been sliced into multiple pieces, each individual piece would represent a different pole. The hysteresis magnet 62 is located between the drive magnets 56 and 55. When the drive magnets 56 and 55 have poles of North and South that are directly lined up opposite each other, the magnetic flux goes straight through the center of the hysteresis magnet 62. This is the minimum torque position of this apparatus. When the poles of the drive magnets 56 and 55 line up North and North directly opposite each other, the flux goes into the center hysteresis magnet 62, travels circumferentially around the magnet, and then exits to a south pole. Because the flux travels so far within the hysteresis magnet 62, this is the maximum torque position of the magnets. Thus, in this invention, the torque is adjusted by changing the relative angular positions of the magnetic poles of the drive magnets 56 and 55 to each other, and the torque is not adjusted or influenced by the air gaps between the magnets as in the prior art devices.

In FIG. 1, it should be noted that there are two torque adjustment set screws 66 that are inserted through the wall 67 of the magnetic clutch housing 57 to impede the movement of the torque adjustment rotating end cap 15. When it is desired to adjust the torque, the screws 66 are loosened and the adjustment is made, then the screws 66 are tightened to hold the torque adjustment rotating end cap 15.

Turning now to FIG. 4, which is a full cross sectional side view of the device 1 of FIG. 1, through lines B-B of FIG. 1, there is shown a bolt 68 that holds the magnet mounting plate 59 to the magnetic clutch housing 57 and also there is shown a screw 69 that holds the first, non-moveable drive magnet 56 to the torque ring 54, so that it cannot move out of position. The terminal end 41 of the magnetic clutch assembly contains a chuck, not shown, that is used to grip the caps that are used for capping containers.

In FIG. 3, the upper double row angular contact thrust bearing magnetic clutch housing 57 and the upper end 70 of the lower shaft housing 59 contain a seal 72 between them to seal the bearings 58 from the influence of liquids. In addition, the first housing assembly 2 lower portion 5 of the housing and the outside edge 74 of the upper double row angular contact thrust bearing magnetic clutch housing 57 have a seal 73 between them to seal off any influence from liquids.

Figure 6:
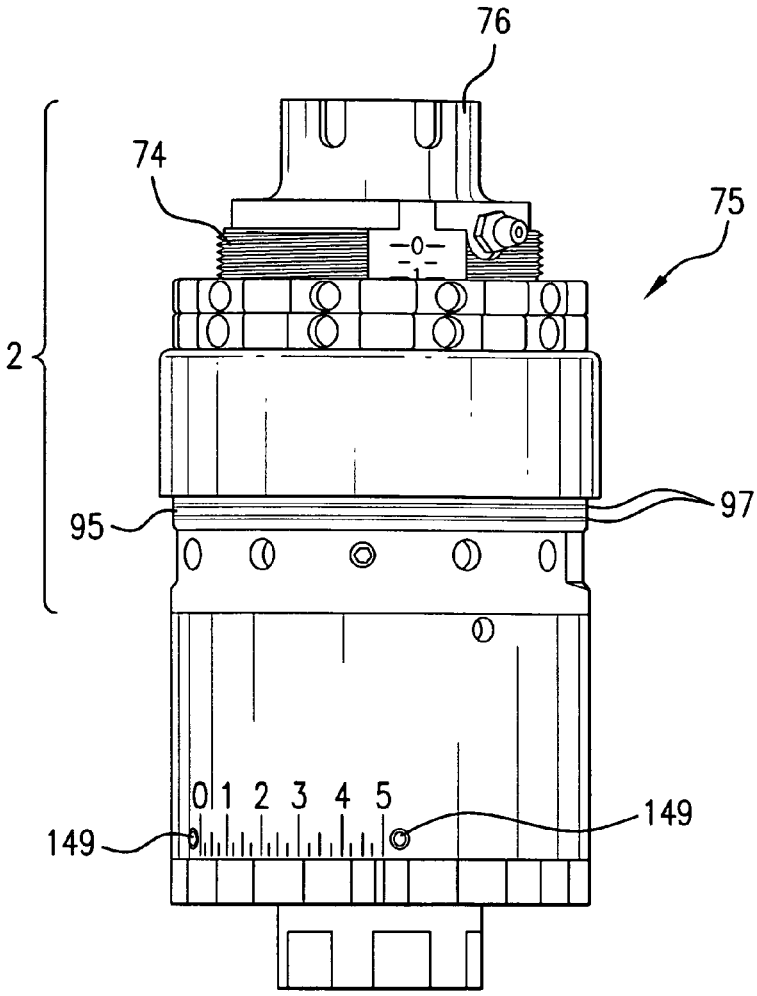
FIG. 6 is a full side view of another embodiment of this invention.
Figure 8:
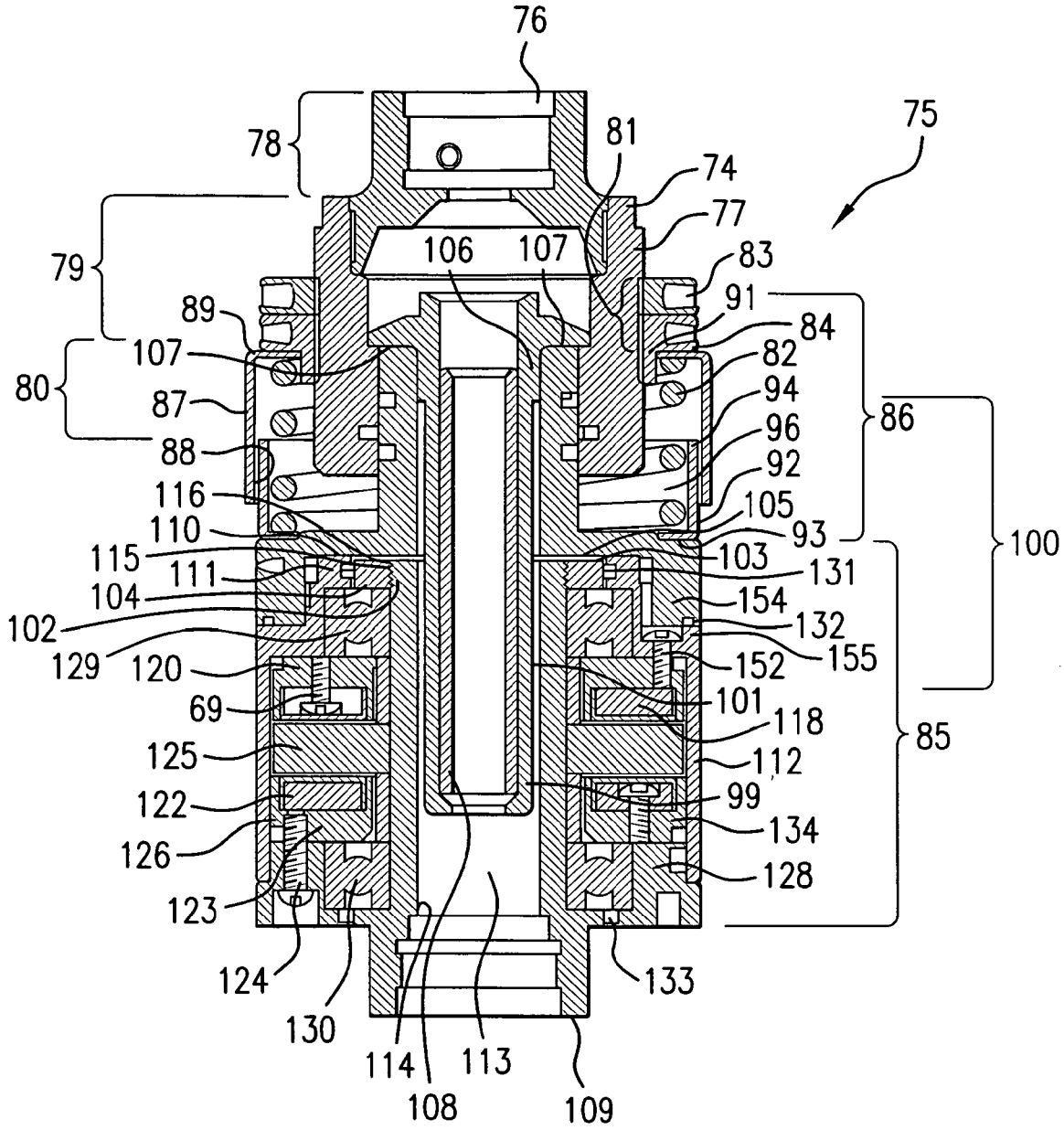
FIG. 8 is a full cross sectional top view taken through line C-C of FIG. 7.

Turning now to one other embodiment of this invention, there is shown in FIG. 6, a capping head assembly 75 comprising a first housing assembly 74, securable to a drive spindle (not shown) through a spindle adapter 76. The first housing assembly has an outside surface 77 and a top portion 78, a middle portion 79, and a lower portion 80, best viewed in FIG. 8.

There is a spring retention plate 81 for the compression spring 82. The spring retention plate 81 surrounds the first housing assembly 74 and is comprised of a combination of an upper jam nut 83 and a lower adjustment ring 84.

The compression spring 82 is mounted beneath the lower adjusting nut 84 and the compression spring 82 surrounds the first housing assembly 74. The compression spring 82 rests on a lower portion 85 of the magnetic clutch housing 100, described infra.

The upper housing assembly 86 is shielded by a two-piece cup assembly, the two-piece cup assembly comprised of an independent upper cup 27 having an open bottom 28, a top 29 and a bottom edge 30, The top 29 has a large central opening 91 through it to accommodate the first housing assembly 74.

The independent upper cup 87 is mounted between the compression spring 82 (beneath it) and the lower adjustment ring 84 (over it), the independent upper cup 87 being retained in place by the adjustment ring 84.

There is an independent lower cup 92 having a bottom 93, an open top 94, and an outside surface 95. The bottom 93 has a large central opening 96 through it. The independent lower cup 92 is mounted under the compression spring 82 and the independent lower cup 92 is retained in place by a first upper housing 86 of the magnetic clutch assembly 100, the bottom edge 90 of the independent upper cup 87 slightly overlaps the independent lower cup 92, and slides independently of the independent lower cup 92.

The independent lower cup 92 has tooled into its outside surface 95, multiple circumferential lines 97 having a predetermined spacing between them that allows for tracking the adjustment of the compression spring 82.

The other major part of the capping head assembly 75 is the magnetic clutch assembly and it is contained in a magnetic clutch assembly housing 100. The magnetic clutch assembly housing 100 is comprised of an upper housing 86, and a lower housing 85. The upper housing 86 contains a metal tube 99 comprised of a lower portion 101 having a top edge 102, and an upper nut portion 103 having a lower edge 104 and a top 105.

The top edge 102 of the lower portion 101, and the lower edge 104 of the upper nut portion 103 are threaded such that they mate and thread together.

In addition, in the upper portion 86, there is a another threaded portion consisting of a flanged nut 106, the flanged nut 106 having a diameter larger than the diameter of the upper housing 86, the difference in diameter of the upper housing 86 and the flanged nut 106 providing a stop 107 for any upward movement of the first housing assembly 74. The metal tube 99 has a plastic tube insert 108. The lower housing 85 has a bottom end outside edge 109 which will be discussed infra.

The lower housing 85 comprises a container for the magnetic components of the capping head assembly 75. The lower housing 85 has a top 110, a shouldered portion 111 near the top 110, an outside wall 112, and an interior metal tube 99, interior plastic tube 108, in hollow shaft 113, with a bottom portion 114, and a bottom edge 109.

The first assembly 2 has a threaded upper end 149 and the first assembly 2 is held in place by the threaded nut 150. The threads 151 of the threaded nut 150 mate with the threaded upper end 149 of the first assembly 2.

Surrounding the interior hollow shaft 113 is a first annular drive magnet 118 set in a torque ring 119 that is not movable relative to the magnetic clutch assembly. This drive magnet 118 has a multiple pole configuration. The first annular drive magnet 118 is held in place by a first magnet plate 120, wherein the first annular drive magnet 118 is screwed to the first magnet plate 120 by screws 69.

There is a second annular drive magnet 122 in the magnetic clutch assembly that has a multiple pole configuration. The second annular drive magnet 122 is held in place by a second magnet plate 123 using bolts 124.

There is a moveable hysteresis annular magnet 125 interposed between the first annular drive magnet 118 and the second annular magnet 122, the magnets being axially spaced from each other and each drive magnet being potted in a potting compound 126.

There is a means for adjusting the position of the drive magnet relative to the magnetic clutch assembly. This means comprises a torque adjustment rotating end cap 128 that changes the polarity of the second annular magnet 122 in the magnetic clutch assembly relative to the first annular drive magnet 118 in a predetermined position whereby the flux of the magnets can be changed to vary the torque limit of the magnetic clutch assembly. The torque adjustment rotating end cap 128 is rotatably mounted in the bottom end of the magnetic clutch assembly. There is a means for securing the drive magnet relative to the magnetic clutch assembly to retain the torque ring 119 in a fixed position.

In FIG. 6, it should be noted that there are two torque adjustment set screws 149 that are inserted through the wall 112 of the magnetic clutch housing 100 to impede the movement of the torque adjustment rotating end cap 128. When it is desired to adjust the torque, the screws 149 are loosened and the adjustment is made, then the screws 149 are tightened to hold the torque adjustment rotating end cap 128.

There is a first radial ball bearing 129 located supra to the first annular drive magnet 118. This first radial ball bearing 129 encircles the rotatable drive member. There is a second radial ball bearing 130 located infra to the second annular drive magnet 122. This second radial ball bearing 130 also encircles the rotatable drive member.

There are four seal locations to prevent the entry of liquids, namely, water used in washing the capping head assemblies, and liquids that are being bottled using the capping head assembly.

The seals are located between:

the threaded ring nut 103 and the upper portion of the shouldered second lower housing 111, seal 131;

the upper housing bottom end outside edge 154 and the lower housing shouldered portion near the top 155, seal 132;

the torque adjustment rotating end cap 128 and the bottom portion of the interior hollow shaft 111, seal 133, and second magnet plate 123 and the lower edge of the lower housing 85 of the magnetic clutch assembly, seal 134.

Figure 7:
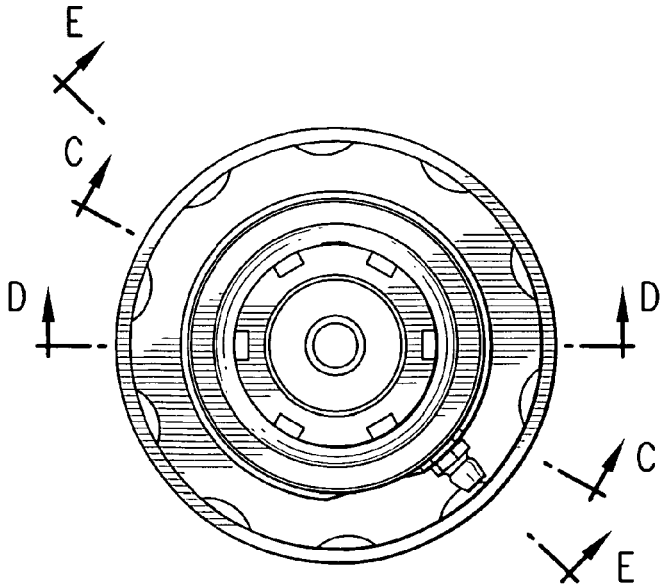
FIG. 7 is a full top view of the device of FIG. 6.
Figure 9:
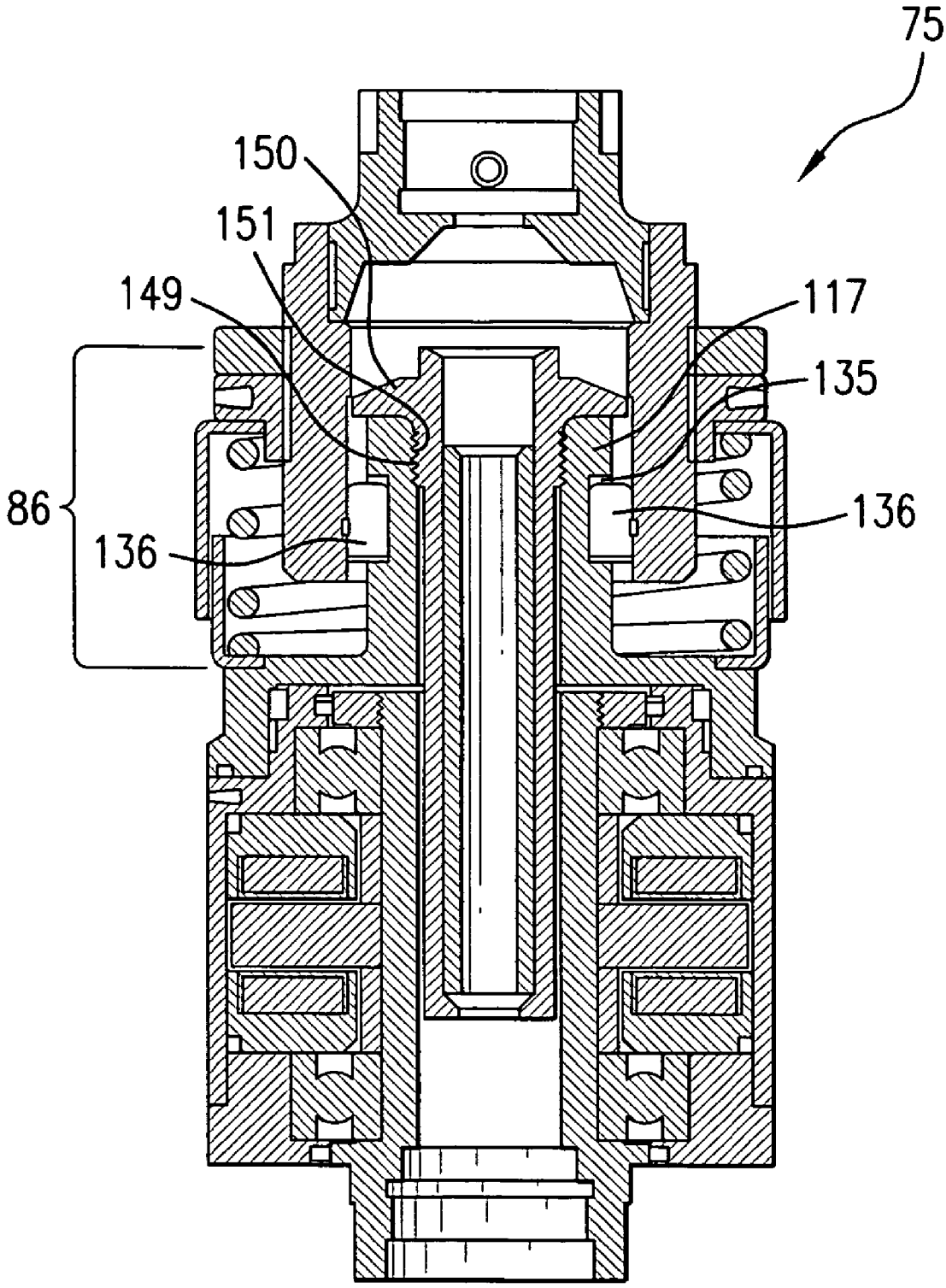
FIG. 9 is a full cross sectional side view of FIG. 6 taken through line D-D of FIG. 7.

Turning now to FIG. 9, which is a cross sectional view of the device of FIG. 6, through line D-D of FIG. 7, in the upper portion 86 of the magnetic clutch housing 100, there is shown the wall 117. The exterior of the wall 117 has semi-cylindrical indentions 135 located there, typically about four such indentions. The indentions 135 are circumferentially located about the upper portion 86 of the magnetic clutch housing 100, and each holds a metal pin 136, which acts as a device to transmit torque from the drive spindle, thru the wall to the magnetic clutch assembly 100. Typically there are four such metal pins 136 in each wall 117 and it is preferred that these pins are manufactured out of stainless steel to prolong the life of such pins. The torque from the drive shaft is transmitted to the magnetic clutch assembly 100 through the metal pins 136.

Figure 10:
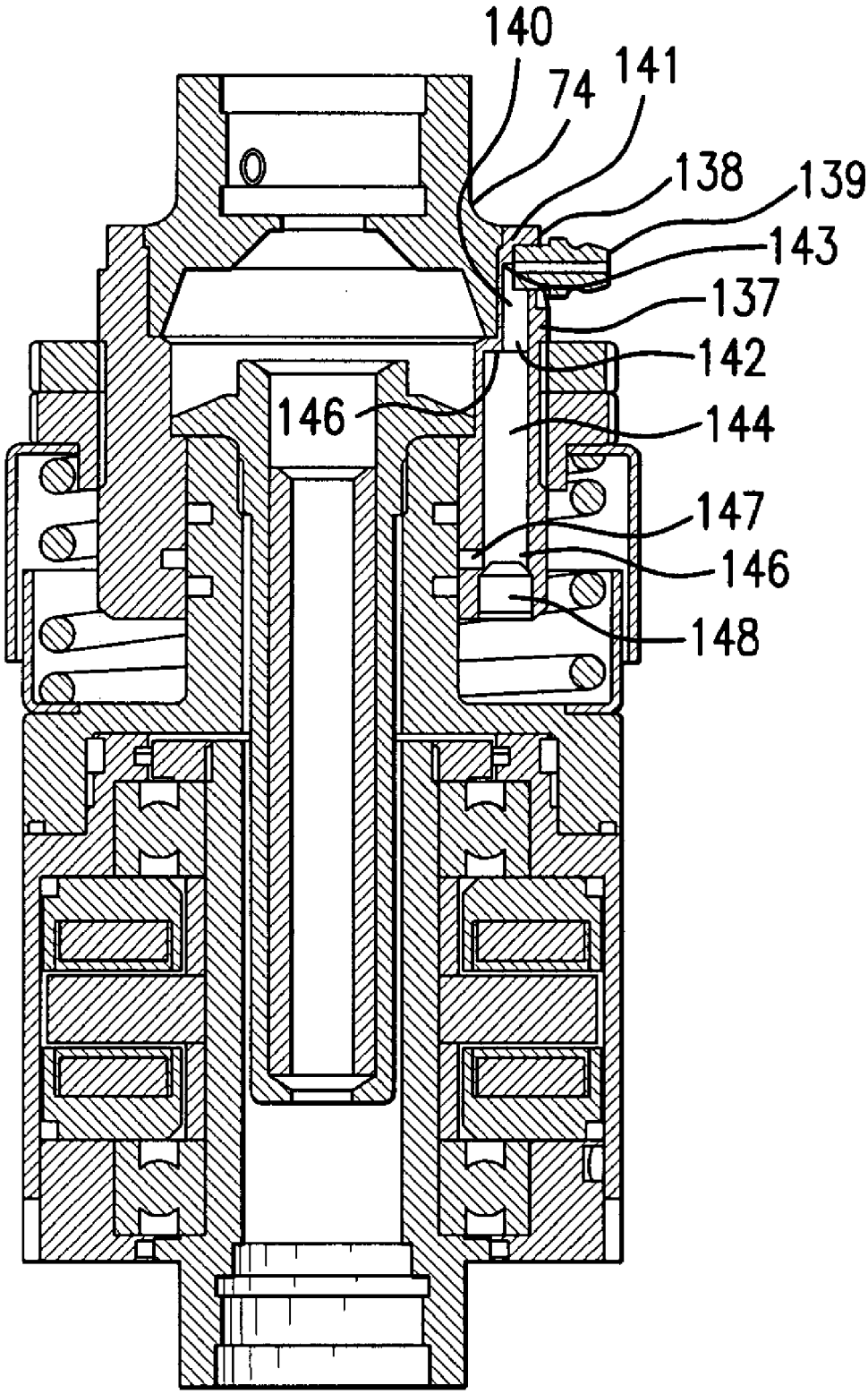
FIG. 10 is a full cross sectional side view of FIG. 6 taken through line E-E of FIG. 7.

Turning now to FIG. 10, which is a cross sectional view of the device of FIG. 6 taken through line E-E of FIG. 7, there is shown the lubrication system for the metal pins 136. The first housing assembly 74 has a multiple component grease port assembly contained in the interior of the wall 137. The multiple component grease port assembly comprises a first opening 138 in the first housing assembly wall 137 containing a grease zerk 139 therein.

There is a first vertical shaft 140, having a predetermined diameter less than the thickness of the wall 137, a top end 141, a bottom end 142. The first vertical shaft 140 has a first opening 143 in the top end 141 that opens to the grease zerk 139.

There is a second vertical shaft 144 having a diameter greater than the first vertical shaft 140, but less than the thickness of the wall 137. The second vertical shaft 144 has an upper opening 145 and a lower opening 146, the lower opening 146 being plugged with plug 148, the upper opening 145 aligning with the bottom end 142 of the first vertical shaft 140 and the bottom end 142 having an opening 147 passing through the wall 137 and into the metal pins 136 and indentions 135.

What is claimed is:

1. A capping head assembly comprising:

(I) a magnetic clutch assembly having an upper portion and a bottom edge and comprising:

(i) a first annular drive magnet in a torque ring that is not movable relative to the magnetic clutch assembly having a multiple pole configuration;

(ii) a second annular drive magnet in the magnetic clutch assembly having a multiple pole configuration;

(iii) a moveable hysteresis annular magnet interposed between (i) and (ii), said magnets being axially spaced from each other;

(II) a means for adjusting the position of the second annular drive magnet relative to said magnetic clutch assembly, said means comprising a torque adjustment rotating end cap, that changes the polarity of the second annular magnet in the magnetic clutch assembly relative to the first annular drive magnet in a predetermined position whereby the flux of the magnets can be changed to vary the torque limit of said magnetic clutch assembly, said torque adjustment rotating end cap being rotatably mounted in the bottom end of magnetic clutch assembly;

(III) a means for securing the second annular drive magnet relative to said magnetic clutch assembly to retain said second annular drive magnet in a fixed position;

(IV) a double row angular contact thrust bearing located in the upper portion of the magnetic clutch assembly and encircling the rotatable drive member, said double row angular contact thrust bearing surmounting the first annular series of magnets;

(V) a first housing assembly securable to a drive spindle, said first housing assembly having an outside surface and said first housing assembly having a top portion, a middle portion, and a lower portion;

(VI) a spring retention plate surmounting the first housing assembly;

(VII) a compression spring mounted beneath the spring retention plate and surrounding the first housing assembly, said spring slidably resting on a movable adjustment ring that is threadedly mounted around the middle portion of the first housing assembly;

the first housing assembly lower portion having an outside wall and said first housing assembly being shielded by a two-piece cup assembly, said two-piece cup assembly comprising:

(i) an independent upper cup having an open bottom, a top and a bottom edge, said top having a large central opening therethrough; said upper cup being mounted over the compression spring and said upper cup being retained in place by the spring retention plate;

(ii) an independent lower cup, said lower cup having a bottom, an open top, and an outside surface, said bottom having a large central opening therethrough; said lower cup being mounted under the compression spring and said lower cup being retained in place by the adjustment ring, the bottom edge of the upper cup slidably overlapping the outside surface of the lower cup;

the upper double row angular contact thrust bearing magnetic clutch housing and the upper end of the lower shaft containing a seal therebetween to seal the bearings;

the first housing assembly housing and the outside edge of the upper double row angular contact thrust bearing magnetic clutch housing having a seal therebetween;

(VIII) a multiple component grease port assembly contained in the interior of the wall of the lower portion of the first housing assembly housing, said multiple component grease port assembly comprising:

(i) a first vertical shaft having a predetermined diameter less than the thickness of the wall of the lower portion of the first housing assembly, a top end, a bottom end, an upper segment, and a lower segment, said first vertical shaft having a first opening in the top thereof that is sealed with a removable plug, said lower segment having a diameter less than the diameter of the upper segment, and, said first vertical shaft having a second opening through the side wall of the first vertical shaft upper segment, to the upper portion of the first housing assembly;

(ii) said first vertical shaft having contained therein, a resilient spring surmounting a metal ball bearing and in contact therewith, said metal ball bearing located at a juncture of the upper segment and the lower segment of the first vertical shaft;

(iii) a second vertical shaft openly connected to the first vertical shaft, said second vertical shaft having a bottom end, said bottom end being sealed with a removable plug;

(iv) an angled shaft openly connected to the second vertical shaft and opening through the outside wall of the lower portion of the first housing assembly housing.

2. The capping head assembly as claimed in claim 1 wherein, in addition, there is an application torque setting scale tooled into the outside surface of the magnetic clutch assembly, near the bottom edge thereof.

3. The capping head assembly as claimed in claim 1 wherein there is a solid lubricant packed into each of the single row bearings.

4. The capping head assembly as claimed in claim 1 wherein the means for securing the second annular drive magnet relative to said magnetic clutch assembly to retain said second annular drive magnet in a fixed position, is a set of two set screws, positioned through the housing of the magnetic clutch assembly near the bottom edge, and on either side of the magnetic clutch assembly torque setting scale.

5. A capping head assembly comprising:

(I) a first housing assembly securable to a drive spindle through a spindle adapter, said first housing assembly having an outside surface and said first housing assembly having a top portion, a middle portion, and a lower portion;

(II) A spring retention plate surrounding the first housing assembly, said spring retention plate comprising a combination of a lower jam nut and an upper adjustment ring;

(III) a compression spring mounted beneath the lower jam nut and surrounding the first housing assembly, said spring slidably resting on the a portion of a magnetic clutch housing;

(IV) said first housing assembly being shielded by a two-piece cup assembly, the lower portion of the first housing assembly having an outside wall and said first housing assembly being shielded by a two-piece cup assembly, said two-piece cup assembly comprising:

(i) an independent upper cup having an open bottom, a top and a bottom edge, said top having a large central opening therethrough; said upper cup being mounted over the compression spring, and under the adjustment nut, and said upper cup being retained in place by the adjustment nut;

(ii) an independent lower cup, said lower cup having a bottom, an open top, and an outside surface, said bottom having a large central opening therethrough; said lower cup being mounted under the compression spring and said lower cup being retained in place by an upper housing of a magnetic clutch assembly, the bottom edge of the upper cup slidably overlapping the outside surface of the lower cup, the outside surface of the lower cup having multiple circumferential lines having a predetermined spacing between them tooled into said outside surface;

(V) a magnetic clutch assembly housing comprising:

(i) an upper housing containing a metal tube comprised of a lower portion having a top edge, and an upper nut portion having a lower edge and a top, the top edge of the lower portion and the lower edge of the upper nut portion being threaded such that they mate and thread together, the nut having a flange at the top, said flange having a diameter larger than the diameter of the upper housing, the difference in diameter of the upper housing and the flange, providing a stop for any upward movement of the said first housing assembly;

said metal tube having fitted within it, a plastic tube insert, said upper housing having a bottom end outside edge;

(ii) a lower housing comprising a container for magnetic components of the capping head assembly, said lower housing having a top, a shouldered portion near the top, an outside wall, and an interior hollow shaft with a bottom portion, and a bottom edge, said shaft having a threaded upper end, said shaft being held in place by a threaded ring nut wherein the threads of the threaded ring nut mate with the threaded upper end of the hollow shaft, wherein there is:

(a) a first annular drive magnet in a torque ring that is not movable relative to the magnetic clutch assembly, having a multiple pole configuration, said first annular drive magnet being held in place by a first magnet plate;

(b) a second annular drive magnet in the magnetic clutch assembly having a multiple pole configuration said second annular drive magnet being held in place by a second magnet plate;

(c) a moveable hysteresis annular magnet interposed between (a) and (b), said magnets being axially spaced from each other, and each drive magnet being potted in a potting compound;

(VI) a means for adjusting the position of the second annular drive magnet relative to said magnetic clutch assembly, said means comprising a torque adjustment rotating end cap, that changes the polarity of the second annular magnet in the magnetic clutch assembly relative to the first annular drive magnet in a predetermined position whereby the flux of the magnets can be changed to vary the torque limit of said magnetic clutch assembly, said torque adjustment rotating end cap being rotatably mounted in the bottom end of the magnetic clutch assembly;

(VII) a means for securing the second annular drive magnet relative to said magnetic clutch assembly to retain said second annular drive magnet in a fixed position;

(VIII) a first single row contact bearing located supra to the first annular drive magnet and encircling the rotatable drive member;

(IX) a second single row contact bearing located infra to the second annular drive magnet and encircling the rotatable drive member;

(X) the threaded ring nut and the upper portion of the shouldered second lower housing containing a seal therebetween to seal the bearings;

(XI) the upper housing bottom end outside edge and the lower housing shouldered portion near the top having a seal between them, there being a seal between the torque adjustment rotating end cap and the bottom portion of the interior hollow shaft, there being a seal between the second magnet plate and the lower edge of the lower housing of the magnetic clutch assembly.

6. A capping head assembly as claimed in claim 5 wherein the first housing assembly has a multiple component grease port assembly contained in the interior of the wall of the first housing, said multiple component grease port assembly comprising:

(i) a first opening in the first housing assembly wall containing a grease zerk therein;

(ii) a first vertical shaft, having a predetermined diameter less than the thickness of the wall, a top end, a bottom end, said first vertical shaft having a first opening in the top end thereof that opens to the grease zerk;

(iii) a second vertical shaft having a diameter greater than the first vertical shaft, but less than the thickness of the wall, said second vertical shaft having an upper opening and a lower opening, the upper opening aligning with the bottom end of the first vertical shaft and the bottom end having an opening passing through the wall and into the top portion of the magnetic clutch housing.

7. The capping head assembly as claimed in claim 5 wherein, in addition, there is an application torque setting scale tooled into the outside surface of the magnetic clutch assembly, near the bottom edge thereof.

8. The capping head assembly as claimed in claim 5 wherein there is a solid lubricant packed into each of the single row bearings.

9. The capping head assembly as claimed in claim 5 wherein the means for securing the second annular drive magnet relative to said magnetic clutch assembly to retain said second annular drive magnet in a fixed position, is a set of two set screws, one positioned through the housing of the magnetic clutch assembly near the bottom edge, and on either side of the magnetic clutch assembly torque setting scale.

* * * * *